US006179737B1

(12) United States Patent
Adler

(10) Patent No.: US 6,179,737 B1
(45) Date of Patent: Jan. 30, 2001

(54) FLYING DISC

(76) Inventor: Alan J. Adler, 752 La Para Ave., Palo Alto, CA (US) 94306

( * ) Notice: Under 35 U.S.C. 154(b), the term of this patent shall be extended for 0 days.

(21) Appl. No.: 08/655,427

(22) Filed: May 28, 1996

Related U.S. Application Data

(63) Continuation of application No. 08/370,059, filed on Jan. 9, 1995, now abandoned.

(51) Int. Cl.[7] ..... A63B 65/10
(52) U.S. Cl. ..... 473/588; 446/46
(58) Field of Search ..... 473/588, 590, 473/589; 446/46–48

(56) References Cited

U.S. PATENT DOCUMENTS

| | | | | |
|---|---|---|---|---|
| 2,798,722 | | 7/1957 | Fluhrer | 273/106 |
| 3,359,678 | | 12/1967 | Headrick | 46/74 |
| 3,544,113 | * | 12/1970 | Hand | 273/424 |
| 3,563,548 | | 2/1971 | Tolott | 273/95 |
| 3,566,532 | | 3/1971 | Wilson | 46/74 |
| 3,724,122 | | 4/1973 | Gillespie, Sr. | 46/74 D |
| 3,959,915 | | 6/1976 | Kettlestrings | 46/74 D |
| 4,253,269 | | 3/1981 | Sullivan | 46/74 D |
| 4,279,097 | | 7/1981 | Walker | 46/74 D |
| 4,479,655 | * | 10/1984 | Adler | 273/425 |
| 4,560,358 | | 12/1985 | Adler | 446/46 |
| 4,915,661 | | 4/1990 | Getgey | 446/48 |
| 5,366,403 | * | 11/1994 | Weiss | 273/425 |

FOREIGN PATENT DOCUMENTS

| | | | | |
|---|---|---|---|---|
| 1201-734 | | 3/1986 | (CA) | 273/168 |
| 8447 | * | 4/1910 | (FR) | 273/425 |
| 8447 | | of 1910 | (GB) . | |
| 289986 | | 5/1928 | (GB) . | |
| 2039760 | * | 8/1980 | (GB) | 446/48 |

OTHER PUBLICATIONS

Edward Edelson, "Lord of the Rings" Popular Science, pp. 94–95, Sep. 1986.*

* cited by examiner

*Primary Examiner*—Steven Wong
(74) *Attorney, Agent, or Firm*—Townsend and Townsend and Crew LLP

(57) ABSTRACT

A flying disc (1) comprises an outer rim (3) encompassing a contiguous thin central plate (2). The rim has a cross-section comprising an outer surface (4), top and bottom edges (5, 8), and fillet curves (6, 9) joining the top and bottom edges to the respective top and bottom surfaces (7, 10) of the central plate. The total height (11) of the rim is the vertical distance between the top and bottom edges. A second height (12) is the vertical distance from the bottom edge to the point (13) where the top fillet curve becomes parallel to the top surface of the central plate. The second height should be between 55% and 80% of the total height in order to achieve balanced aerodynamic lift and thus a straight flight.

12 Claims, 5 Drawing Sheets

FLYING DISC

This is a Continuation Division of application Ser. No. 08/370,059 filed Jan. 9, 1995, now abandoned

BACKGROUND OF THE INVENTION

Flying discs, intended for throwing and catching are well known throughout the world. A typical example is Headrick, U.S. Pat. No. 3,359,678. The disc comprises a rim encompassing a contiguous thin central plate. The rim has substantial vertical height and which adds substantial aerodynamic drag. However the rim is required to provide at least some degree of directional stability. Without the rim the disc will veer severely sideways in flight.

Despite their popularity, prior art discs have serious limitations. The three most vexing problems are listed below:

First, the configuration of the rim causes many throwers to launch the disc with wobble. This very common complaint and has driven many people away from the sport.

Second, the flight direction is velocity sensitive. For a right-handed throw, the disc rolls right during the initial part of the flight and rolls left during the final part of the flight. In addition the rate of roll is highly variable due to the type of throw and the velocity and direction of the prevailing winds. This makes it very difficult to throw these discs accurately.

Third, the substantial aerodynamic drag limits flight range and/or requires a strong throw.

SUMMARY OF THE INVENTION

The invention is a flying disc, intended for throwing and catching, which overcomes the problems of prior art flying discs.

In brief, a disc according to the invention comprises an outer rim encompassing a contiguous thin central plate. The rim has a cross-section comprising an outer surface, top and bottom edges, and fillet curves joining the top and bottom edges to the respective top and bottom surfaces of the central plate.

The shape of the disc of the invention fits the thrower's hand in a manner which allows the disc to be launched totally free of wobble. The disc of the invention has balanced aerodynamic lift, which results in a straight flight without a tendency to roll left or right in flight. The aerodynamic drag of the disc of invention is lower than that of prior art discs. This results in longer flights and easier throws.

A further understanding of the nature and advantages of the present invention may be realized by reference to the remaining portions of the specification and the drawings.

DESCRIPTION OF SPECIFIC EMBODIMENTS

A Brief Note About Aerodynamic Balance

The flying disc of the invention achieves stable and accurate flight by having the center of aerodynamic lift and the center of gravity (Cg) coincident. For purposes of this disclosure, this condition of coincidence is termed aerodynamic balance. If aerodynamic balance is not present, the disc will roll to the left or right in flight.

The following discussion assumes that the disc is spinning clockwise when viewed from above. (For counterclockwise rotation, the roll directions cited below are reversed).

If the center of lift is forward of the Cg, gyroscopic precession will roll the disc to the left in flight. Conversely, if the center of lift is aft of the Cg, the disc will roll right in flight.

The location of the center of lift of most prior art discs is velocity sensitive. The center of lift is aft of the Cg during the high-speed beginning of the flight and ahead of the Cg during low-speed end of the flight. Thus these prior art discs roll right at the beginning of the flight and roll left at the end of the flight. Expert throwers compensate by launching the disc with a substantial initial left tilt. If done correctly, the disc will roll right during the beginning of the flight and become level by mid flight. However the thrower can do little to counter the left roll at the end of the flight. He must also adjust is throw for prevailing winds. When throwing into the wind the higher air speed produces greater right roll, thus more initial left tilt is demanded.

Disc Configuration and Advantages

Figure 1:
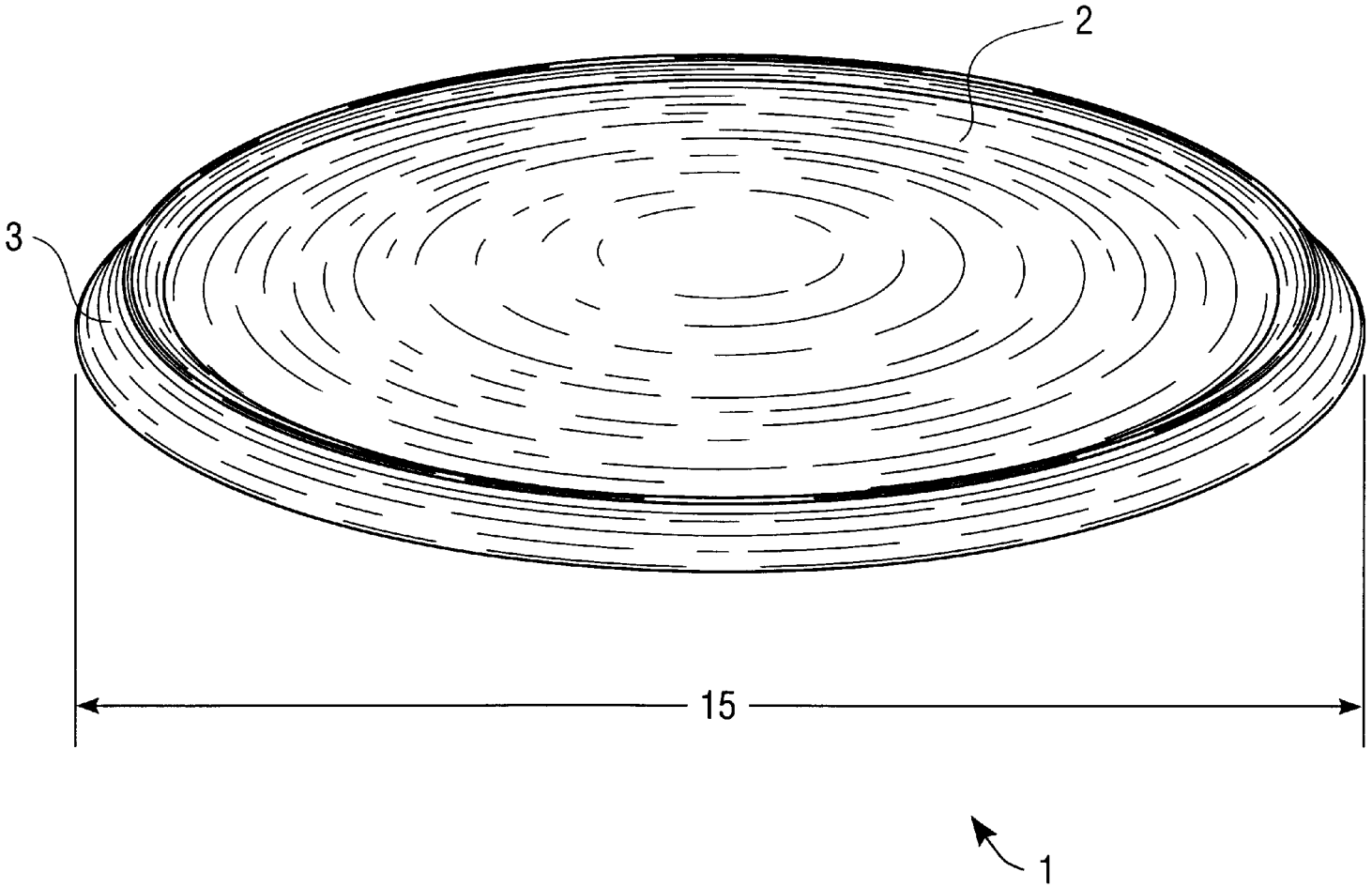
FIG. 1 is an isometric view of the invention.

FIG. 1 shows a flying disc 1 according to the invention. Disc 1 comprises a contiguous thin central plate 2 and an outer rim 3, encompassing said central plate. The entire disc has an outside diameter 15. The remaining figures show details of the rim region of the invention.

Figure 2:
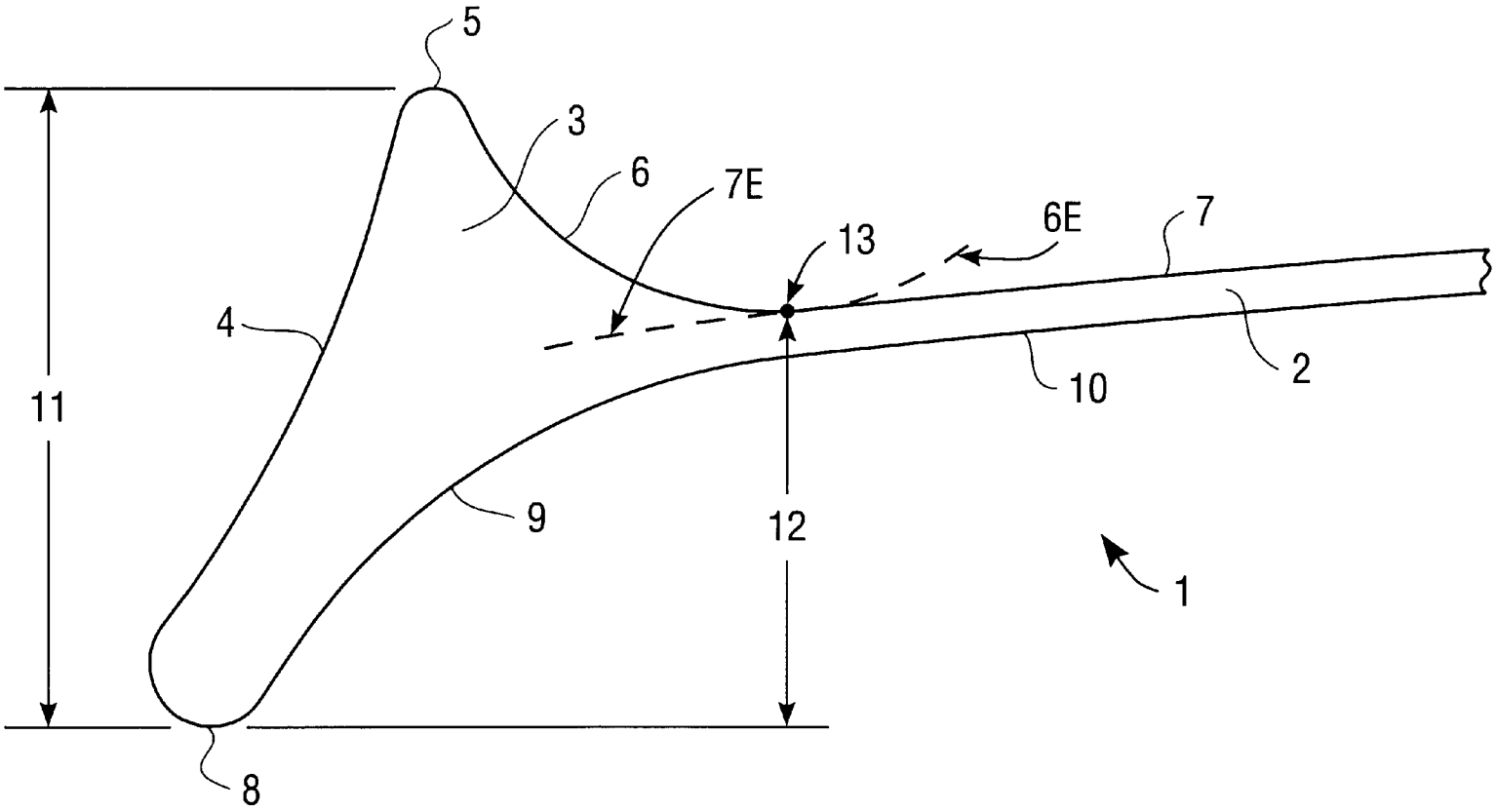
FIG. 2 is a cross section of the rim region of the preferred embodiment of the invention.

FIG. 2 is a cross section of the rim region of disc 1. Rim 3 has a cross-section comprising an outer surface 4, a top edge 5, and a top fillet curve 6 which joins the top edge to the top surface 7 of the central plate. The rim also has a bottom edge 8 and a bottom fillet curve 9 which joins the bottom edge to the bottom surface 10 of the central plate. This novel rim shape contributes to the excellent aerodynamic balance, low aerodynamic drag and superior throwing ergonomics of the invention.

Top edge 5 is the highest part of rim 3. Bottom edge 8 is the lowest part of rim 3. The total height of rim 3, designated 11, is the vertical distance between the top and bottom edges. Height 12 is the vertical distance from the bottom edge to the point 13 where top fillet curve 6 becomes parallel to top surface 7 of the central plate. The location of point 13 can be easily found by drawing construction lines 6E and 7E which are extensions of curves 6 and 7, respectively. At point 13, lines 6,6E and 7,7E become parallel. (Note that in FIG. 2 these lines become both parallel and congruent at point 13. However, in the alternative embodiment of FIG. 4, these lines are simply parallel at point 13). An important feature of the invention is that height 12 should be between 55% and 80% of the total height 11. This is important to achieve balanced aerodynamic lift and thus a straight flight.

Another important feature of the invention is that the total height 11 of the rim should be at least five percent of the outside diameter 15 of the entire disc. If this condition is not met, the center of lift will be too far forward and aerodynamic balance will not be achieved.

Ergonomics are an equally important benefit of the invention. The rim shape permits the thrower to grip the disc near a plane passing through the vertical center of gravity of the disc and facilitates wobble-free throws. The thrower's thumb nestles into top fillet curve 6 in a manner which greatly facilitates accurate and wobble-free throws. Also, the thrower can achieve additional velocity and spin by flinging the disc with his thumb while pressing it against the concave surface created by top fillet curve 6. To further facilitate this benefit, this surface can be molded with a traction-enhancing texture.

The radius measured from the center of the disc to the top and bottom edges may be equal however lower aerodynamic drag is achieved when bottom edge 8 has a greater radius, measured from the center of the disc, than top edge 5.

The central plate 2 of the invention may be flat or convex. The inventor has found that its shape has less effect on flight characteristics than does the configuration of the rim. In the specific embodiment the top plate is slightly convex, being a spherical shell with the top surface having a radius of curvature of approximately 45 inches.

A long standing prior problem with relatively low profile discs has been that the center of lift is forward of the Cg, resulting in left roll in flight. Yet despite its low profile, the invention does not suffer this problem. It is believed that top edge 5 and bottom edge 8, working in concert with their respective fillet curves 6 and 9 deflect the airflow in a manner which causes the center of aerodynamic lift to coincide with the Cg and achieve aerodynamic balance.

Figure 3:
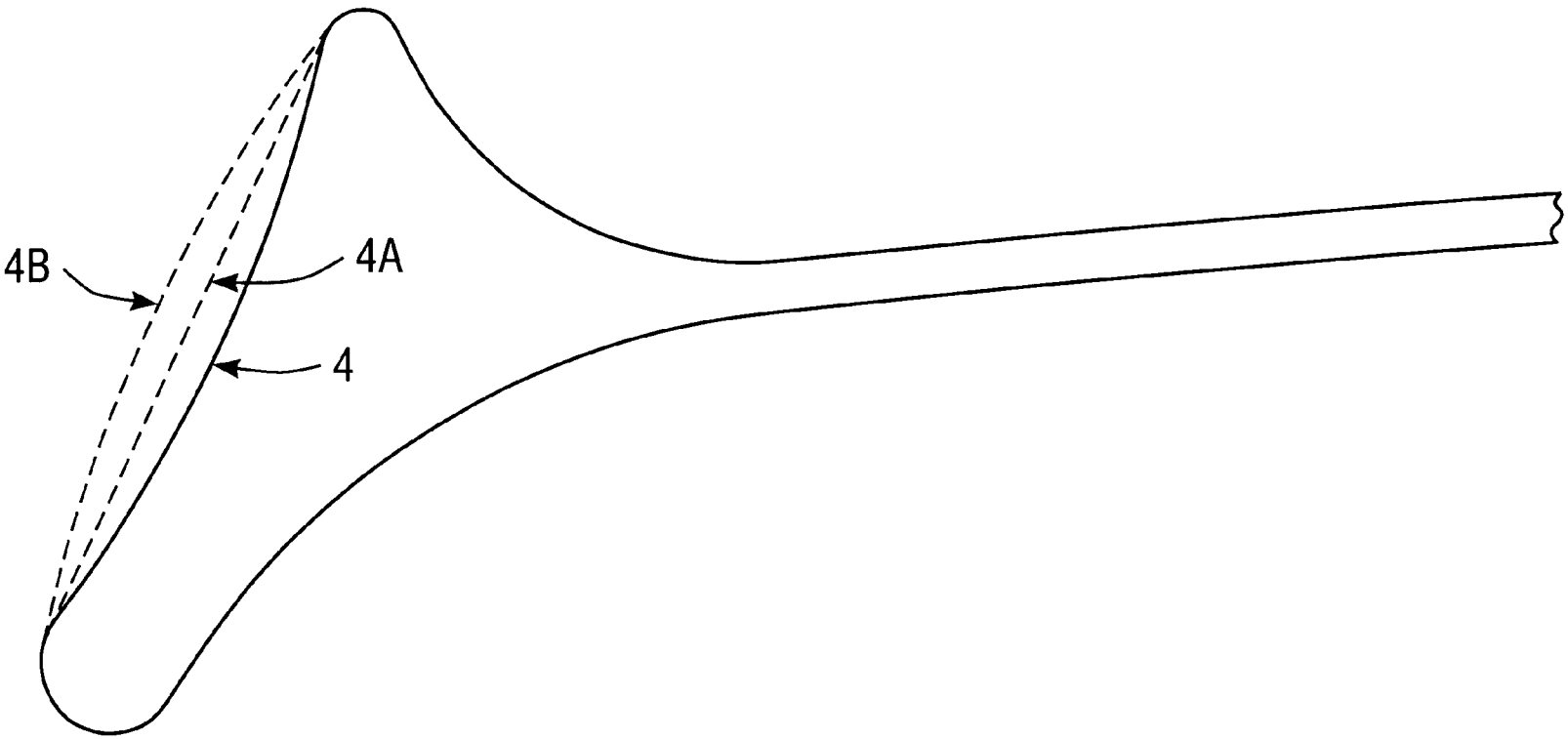
FIG. 3 is a cross section illustrating alternative forms of the invention.

FIG. 3 is a cross section illustrating alternative forms of the outer surface of the rim of the invention. Note that a cross-section line taken through this outer surface may be concave (denoted 4), straight (denoted 4A), or convex (denoted 4B). The inventor has found that greatest flight stability is achieved with a concave cross-section line defining the outer surface. However greater flight distance is achieved with either of the remaining two alternatives.

Note that in the case of the convex outer surface alternative 4B, the amount of convexity should not be not so great that it absorbs and thus eliminates top edge 5 or bottom edge 8. These edges are important to achieve aerodynamic balance.

Figure 4:
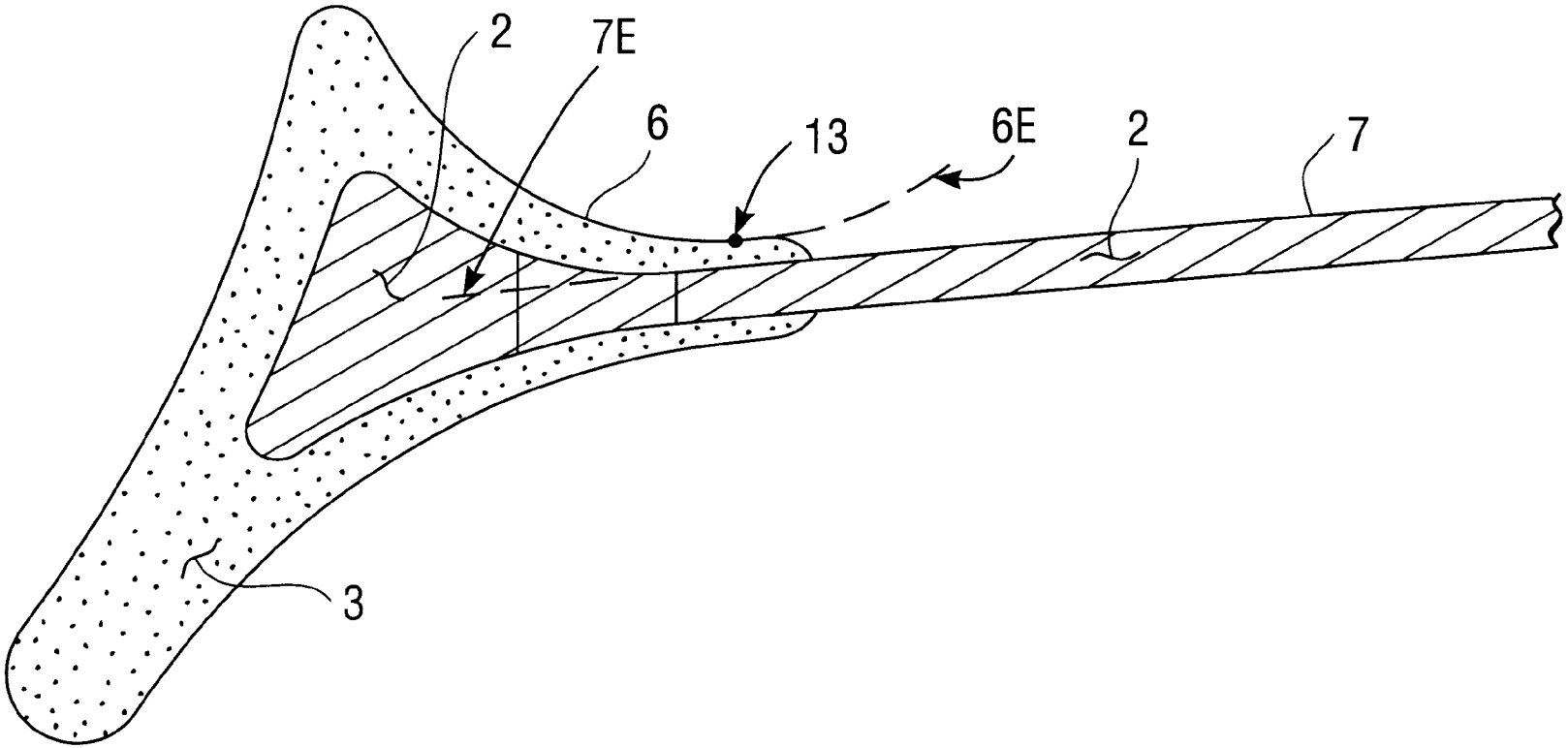
FIGS. 4 and 4*a* illustrate the invention molded in two different materials.
Figure 4A:
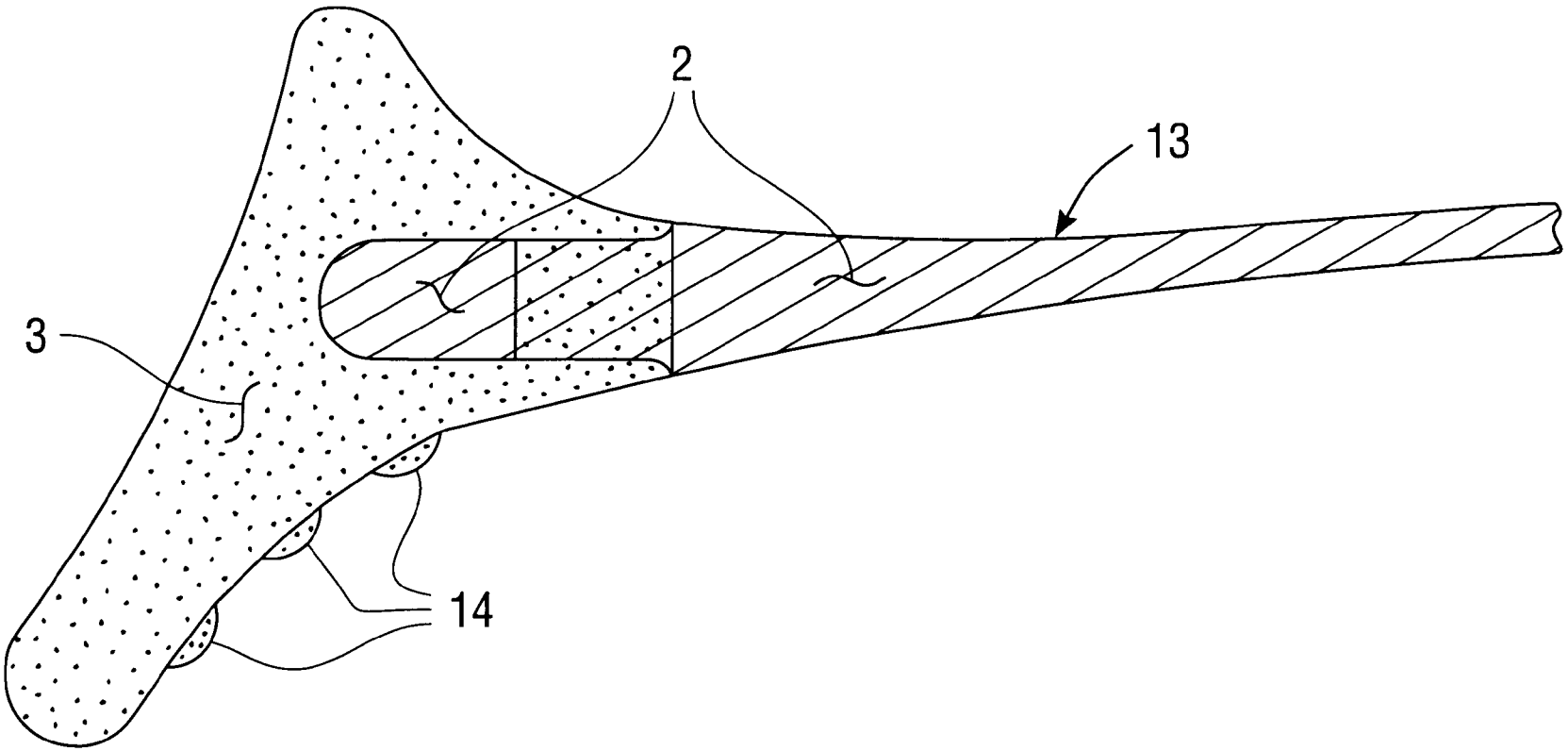

FIGS. 4 and 4*a* illustrate embodiments of the invention molded in two different materials. Central plate 2 is molded of semi-rigid plastic, such as polyethylene or polypropylene. Outer rim 3 is molded of a thermoplastic rubber. The rubber rim improves catching and throwing comfort and resists abrasion—which damages conventional polyethylene discs when they skid on paved surfaces. In FIG. 4, the molding of different materials is facilitated by a slight thickening of the region 13 where the fillet curves become parallel to the central plate. Experiments have confirmed that there is no observable difference in the performance of discs having the cross sections of FIG. 4 and FIG. 2. In FIG. 4*a*, central plate 2 is slightly thickened in order to achieve a smooth transition to the rubber material of outer rim 3. FIG. 4*a* also has traction-enhancing texture bumps 14 on the lower surface of the rim.

Texture could also be employed on other surfaces of plate 2 or rim 3.

Representative dimensions of a disc of the invention are listed below:

Outer Diameter (15)=10 inches

Total Rim Height (11)=0.72 inches

Height (12)=0.50

Center plate thickness=0.05"

Center plate spherical radius=45"

weight=130 grams

These dimensions, of course, are only an example. The novel rim of the invention may be incorporated in discs of other dimensions provided that the total rim height is at least five percent of the total disc diameter.

Experimental Results

The present inventor has conducted research and development on flying toys for the past eighteen years. During that period he invented and patented several world record setting flying rings and numerous boomerangs. In addition, during that same period he conducted numerous flying disc experiments. His goal for flying discs was longer flight distance combined with satisfactory stability (freedom from excessive left or right roll). He tried scores of discs which flew farther but had excessive roll.

Tests included several discs which had rims quite similar to that of the present invention, but were unsuccessful. These discs apparently lacked the proper height for the point of joining of the central plate and the rim.

Finally the present invention was created, combining long flight with not just "satisfactory" stability, but stability far superior to the prior art. In addition, it was discovered that the ergonomics of this invention permitted wobble-free throws.

Conclusion

In conclusion, the present invention provides a flying disc characterized by exceptional stability and ease of use. A relatively unskilled thrower can consistently achieve long, accurate and wobble-free flights.

While the above is a complete description of specific embodiments of the invention, various modifications, alternative constructions, and equivalents may be used. Therefore, the above description should not be taken as limiting the scope of the invention as defined by the claims.

What is claimed is:

1. A flying disc, intended for throwing and catching, having a structure comprising:

a contiguous thin central plan having top and bottom surfaces, an outer rim encompassing said central plate, said rim having an outside diameter and a cross-section comprising an outer surface, a top edge, a bottom edge of greater radius measured from the center of the disc than said top edge, a total rim height, measured from said bottom edge to said top edge, of at least five percent of said outside diameter, a top fillet curve joining said top edge to the top surface of said central plate, and a bottom fillet curve joining said bottom edge to the bottom surface of said central plate, said top fillet curve joining said top surface of said central plate at a height between 55% and 80% of said total rim height.

2. The flying disc of claim 1 wherein a cross-section line taken through said outer surface is concave.

3. The flying disc of claim 1 wherein said central plate is convex.

4. The flying disc of claim 1 wherein said top fillet curve becomes parallel to said top surface of said central plate at a height which is approximately 70% of said total rim height.

5. The flying disc of claim 1 wherein said total rim height, measured from said bottom edge to said top edge, is seven percent of said outside diameter.

6. A flying disc, intended for throwing and catching, having a structure comprising:

a contiguous thin central plate having top and bottom surfaces; and an outer rim encompassing said central plate, said rim having an outside diameter and a cross-section comprising an outer surface, a top edge, a bottom edge of greater radius measured from the center of the disc than said top edge, a total rim height, measured from said bottom edge to said top edge, of approximately seven percent of said outside diameter, a top fillet curve joining said top edge to the top surface of said central plate, and a bottom fillet curve joining said bottom edge to the bottom surface of said central plate, said top fillet curve joining said top surface of said central plate at a height of approximately 70% of said total rim height.

7. The flying disc of claim 6 wherein a cross-section line taken through said outer surface is concave.

8. The flying disc of claim 6 wherein said central plate is convex.

9. A flying disc, intended for throwing and catching, having a structure comprising;

a contiguous thin central plate having top and bottom surfaces, wherein said top surface is convex, an outer rim encompassing said central plate, said outer rim having an outside diameter and a cross-section comprising an outer surface, wherein a cross-section line taken through said outer surface is concave, a top edge, a bottom edge of greater radius measured from the center of the disc than said top edge, a total rim height, measured from said bottom edge to said top edge, of approximately seven percent of said outside diameter, a top fillet curve joining said top edge to the top surface of said central plate at a height of approximately 70% of the total rim height, and a bottom fillet curve joining said bottom edge to the bottom surface of said central plate.

10. The flying disc of claim 9 wherein said outer rim is molded of a thermoplastic rubber and said central plate is molded of semi-rigid plastic.

11. The flying disc of claim 9 wherein said outside diameter is approximately 10 inches.

12. The flying disc of claim 1 wherein said outer rim is molded of a thermoplastic rubber and said central plate is molded of semi-rigid plastic.

* * * * *